United States Patent [19]

Vago

[11] 3,980,123

[45] Sept. 14, 1976

[54] BLOW-MOLDED ARTICULATED OVERHEAD DOOR

[75] Inventor: Louis N. Vago, Aurora, Ill.

[73] Assignee: General Aluminum Corporation, Montgomery, Ill.

[22] Filed: June 12, 1975

[21] Appl. No.: 586,195

[52] U.S. Cl. ..... 160/201; 160/232

[51] Int. Cl.[2] ..... E05D 15/36

[58] Field of Search ..... 160/201, 218, 229 R, 160/232, 202, 209

[56] References Cited

UNITED STATES PATENTS

| | | | |
|---|---|---|---|
| 3,090,427 | 5/1963 | Stroup et al. | 160/209 X |
| 3,104,699 | 9/1963 | Wolf et al. | 160/201 X |
| 3,178,776 | 4/1965 | Stansberry | 160/201 X |
| 3,334,681 | 8/1967 | Crosswell | 160/201 X |

*Primary Examiner*—Philip C. Kannan
*Attorney, Agent, or Firm*—Alter and Weiss

[57] ABSTRACT

An articulated overhead door constructed of blow-molded material sections for use on building structures such as industrial, commercial, and residential garages.

18 Claims, 20 Drawing Figures

BLOW-MOLDED ARTICULATED OVERHEAD DOOR

BACKGROUND OF THE INVENTION

The present invention relates generally to building entry and exit doors and more particularly to an articulated overhead door constructed of blow-molded material sections for garages, warehouses, and factories.

Over the last several years, a number of entry and exit door devices have been developed to provide for the user movable door means through which an entry aperture can be opened and closed. While several of these door assemblies provide building structures secure protection from the elements, few if any, address themselves to the advantages that an articulated overhead garage door constructed of blow-molded plastic sections render. The conventional door devices examined in the prior art, for the most part provide a movably operable door capable of covering a large entrance which has the strength to protect the building enclosure on which it is installed. Of these door assemblies examined, however, most refrain from teaching towards the improvements of 1) better insulation, 2) durability, 3) ease in maintenance, 4) reduction in weight for improved mechanical and power control, 5) explosion proof construction yielding uni-directional give, 6) improved security, 7) resistance to denting and chipping, 8) facilitated replacement of parts, and 9) ease in installation. The present articulated overhead door which is constructed of blow-molded material sections more adequately achieves these advantages which conventionally constructed doors have to date found difficult to accomplish.

One such conventional door examined in the prior art is disclosed in the Ogden U.S. Pat. No. 974,699 door and means for operating same. The Ogden door assembly provides for a door of conventionally constructed panel sections constructed in such a way as to fold the door up above the doorway rather than sliding the door along rails along the doorway. While the patent discloses one of the earlier articulated vertically moving doors, each section pivots at its top or bottom so as to swing inwardly into the building enclosure to which it is attached. The panel sections in the Ogden assembly are pivotally connected at their opposite ends to adjacent sections whereby the sections are arranged in a free swinging relation. The door in its entirety has each panel zig-zag as the door is opened rather than having all panels smoothly following one route during the opening and closing operations.

The door disclosed by Dautrick U.S. Pat. No. 1,603,379 discloses an assembly utilizing the more universally accepted vertical movement technique in which each panel of the door slides along rails in much the same way as most conventionally used garage doors. In this device, rollers on each end of the entire door are guided by a rail track which converts the positioning of the door from that of being vertical in the closed position to that of being substantially horizontal in the open position. Unlike Ogden, the panels follow one another in the movement of the door and do not zig-zag with respect to each other thus avoiding a stacking up of the door panels over the immediate entrance to the building enclosure. For the most part, the Dautrick door addresses itself to the use of counterweights in combination with a door that moves through a predetermined path, to overcome the opening and closing resistance offered by the weight of the door. Dautrick's counterweighting device utilizes flexible chain-like members linked hingedly to one another which are designed to become ineffective as counter-weighting means, as the panels travel along a pre-determined path.

The door construction device disclosed by Cook, et al. U.S. Pat. No. 1,832,966, features still yet another type of articulated overhead door. Rather than sliding along rails from a vertical position to a substantially horizontal position over the building enclosure, the Cook, et al patent discloses a door that utilizes scissor-type tongs to effectuate movement. The section panels comprising the articulated door in the Cook, et al patent do not hinge to one another nor follow one another in a pre-determined path. The panels instead stack up one alongside one another when the door is opened requiring disconnection of one panel from another. The door in its entirety utilizes panels which are connected by linkage arm devices which in turn respond to the movement of the linkages comprising the scissor-type tong assembly. The panels thus overlap one another in a position proximate to the entry to the building enclosure itself. This particular device additionally discloses a motorized means for activating movement of the scissor-type tong linkage.

A door controlling means is disclosed in Rush U.S. Pat. No. 1,938,978. The Rush device comprises a spring controlling means working in operation with an articulated overhead type of door usually of the fire-door variety. The spring control means counter-balances a door when it is in the open position. A switching means attached to the counter balancing spring removes the counter balancing effect of the spring means and thus releases the door into a closed position. The switching means associated with release of the spring counter balancing means is so constructed in the Rush device to provide decreasing resistance as a function of time. This enables closure of the door at a moderate rate so as to avoid shock or jar of a door crashing closed.

Norberg U.S. Pat. No. 2,093,020, discloses a shiftable door member which automatically enables a garage door to accommodate inclined or slanted surfaces which traverse the garage door width. The Norberg device teaches primarily to a bottom rail attachment which fills in an exposed portion of entrance-way due to a slanted or inclined floor which is unable to meet flushly with the bottom of the garage door.

An overhead garage door keeper is disclosed in Rix U.S. Pat. No. 2,426,052. The key feature in this device is the keeper assembly which not only locks the door in its closed position, but exerts pressure against the upper middle section of the garage door entirety so as to prevent the tendency of warpage and/or sagging of the door, problems often encountered with the doors of conventional construction.

Wolfe U.S. Pat. No. 2,619,165, teaches an overhead door structure which is concerned with the braking system used in preventing the door from moving when it is in the overhead horizontal open position. The braking system utilizes a brake shoe and brake plate which cooperate to hold the door at the open position desired.

A panel hinge construction is taught by D'Orazio U.S. Pat. No. 2,916,089. The D'Orazio articulated door structure utilizes a supporting row of hinges between the panel sections; these hinges traveling the length of the door. It is the purpose of the D'Orazio articulated door to avoid the necessity of utilizing heavy structural means or support frame-work within which the panel sections are inserted. The heavy reinforcing skeleton of the door is made needless by utilizing reinforcing hinges which hinge one entire row of garage panel sections to another entire row and which further protect the edges of the adjoining panel section. Thus, D'Orazio replaces a heavy supportive outer structure on the door with a hinge support structure running the entire width of the door.

An articulated door construction is shown in Howell Sr., U.S. Pat. No. 3,023,804. The Howell Sr. door discloses the use of elongated channel strip members on the lower edge of an articulated door which assist in sealing out the weather, and which provide for quiet operation of the door when the door is being moved into the closed position. The Howell Sr. device similarly attempts to reduce the shock to the door when it is lowered into this closed position while providing a convenient attaching means for the cables attached to the counter-balancing springs or weights.

Other devices have been developed to cooperate with a conventionally constructed door such as the device disclosed in Smith U.S. Pat. No. 3,256,118. The Smith device is an overhead door retaining means which retains the position of the door automatically so as to insure a close fit between the header of a building doorway and the upper edge of the overhead door when the door is in a closed position. The Smith retaining means reinforces the top edge of the door so as to resist external wind pressure and so as to guarantee an avoidance of interference when the door is opened and closed. Another device cooperating with the conventional overhead door is disclosed by Lomaz U.S. Pat. No. 3,226,144. The Lomaz device is an overhead door latch which provides latching means for a door without requiring the precision alignment between cooperating locking elements.

It thus becomes apparent, that the articulated overhead door has been in the prior art for some time together with cooperating elements which have been developed to more efficiently utilize such an overhead door. But the conventional door as developed through the years, has, for the most part, been unable to secure the advantages which the present articulated overhead door enables through its blow-molded fabrication and unusual operating means.

It is an object of the present invention, therefore, to facilitate ease in the manufacture and distribution of articulated overhead doors.

It is additionally an object of the present invention to provide a durable maintenance free overhead door which provides improved insulation for a building enclosure, thus minimizing heating and cooling requirements.

Additionally, it is an object of the present invention to provide for an articulated overhead door of minimal weight to facilitate the mechanical or power driven opening and closing of the door.

It is additionally an object of the present invention to provide security to its user through its "double-thick" design, to be explosion proof since constructed with unidirectional give, and to be dent and chip resistant since the blow-molded construction has a degree of flexibility and won't crack or dismember so easily as conventional overhead doors tend to do.

Finally, it is an object of the present device to facilitate ease in the installation of an overhead articulated door while similarly enabling facilitated replacement of panel sections or hardware associated with the blow-molded fabrication of the door.

SUMMARY OF THE INVENTION

The present invention is an articulated overhead door comprising a series of panel sections constructed of blow-molded material having substantially hollow cavities within its double-walled construction.

The panel sections are constructed with horizontal and vertical ribbed corrugations within its interior and exterior walls so as to enable increased strength while affording increased insulation because of its double-walled cavity construction. Within the cavities described by the blow-molded panel sections, is a sealed dead air space which affords to the panel sections these insulation characteristics. All four sides of the rectangularly shaped blow-molded panel sections are given specially designed contours so as to promote the overlapping and integral fit of one panel section with other adjacent panel sections.

The articulated overhead door additionally utilizes a plurality of horizontal rail support means spanning the length of the door which forms part of the framework restraining the blow-molded panel sections securely in place. A plurality of vertical stile support means which span the height of the door connect with the horizontal rail supports through hinging means which attach to the vertical stile supports and through framework attachment means thus completing the fabrication of the framework. These hinging means also pass through slots fabricated through the horizontal rail support means. Specific shaping of the horizontal rail support means enable protection of the top and bottom sides of the panel sections and further enable pivoting of a row section of panels with an adjacent row section of panels. Channel shaping of the vertical stile supports similarly permit the attachment and restraint of adjacent columns of blow-molded panel sections. The vertical stile supports are in turn restrained by the horizontal rail supports.

Various types of horizontal rail supports are incorporated into the construction of the articulated overhead door. One such type of horizontal rail support connects adjoining rows of blow-molded panel sections. Another type of rail support forms the bottom edge of the entire door and further enables the attachment of an astragal weather strip on the lower surface of the door. A third type of horizontal rail support is used as the upper edge of the entire door. A final variation of the horizontal rail support assists the first type of rail support to connect two rows of panel sections and enables the pivoting at panel section row-junctions, as previously described. In the partiicular embodiment shown, the horizontal rail utilized for the upper edge can be replaced by utilizing the rail, described as the final variation. Thus, this embodiment can require only three types of horizontal rail supports.

Three various types of vertical stile supports are incorporated into the construction of the present articulated overhead door. A first type, the standard junction stile, assists in attaching and restraining two columns of adjacent blow-molded panel sections together. A second type of vertical stile support attaches to either the right or left side of the door so as to finish the protruding contoured end of the panel section columns forming the edges of the door. A third type of stile support covers the edge stile supports and locks them in place against the columns forming the edges of the entire garage door thereby providing a surface onto which roller bracket assemblies can be placed. These roller assemblies have protruding roller wheels which will eventually be inserted into a guiding track.

The guiding track means direct the movement of the overhead door and, as conventionally constructed, are comprised of a vertical track channel portion, a curved track channel portion, and a horizontal track channel portion. Thus, the roller means attached to the side edges of the entire door rest in the vertical track channel portion when the door is in a closed position, travel through the curved track channel portion when the door is opened, moving towards a substantially overhead door position, and rest in the horizontal track channel portion when the door is open, placing the door in a substantially horizontal position over the building enclosure.

Roller means which are attached to the two vertical side edges of the door are inserted into the guiding track so as to direct the movement of the rows of panel sections when the door is opened or closed.

Power assist means are utilized to facilitate the opening of the door from a closed position to an open position and, in fact, counterbalance the weight of the door to provide the user with assistance in the opening and closing of the door. Control means which enable the locking, unlocking, mechanical opening, and mechanical closing of the door are further incorporated into the present invention's construction.

In one particular embodiment of the present invention, the panel sections are constructed of blow-molded polyethylene plastic. Additionally, all horizontal rail support means and vertical stile support means comprising the framework which restrain individual panels in place and provide for the interaction of adjoining panel sections, are constructed of extruded aluminum so as to minimize their weight while maximizing their strength and support characteristics.

The user of the present invention would merely need to order the number of panel sections and horizontal and vertical supports necessary to construct an overhead articulated door of a desired proportion. The composite parts utilized in making up a desired door would for all practical purposes, comprise a modular assembly affording simple yet sturdy installation while similarly providing easy replacement features.

The door as characterized above provides for the manufacturer ease in fabrication while providing for the user, the advantages of improved insulation, durability, reduced maintenance, lightweight operation, uni-directional give for explosion-proofing, security through double-thick construction, dent and chip resistance, facilitated replacement, and ease in installation.

DETAILED DESCRIPTION OF THE DRAWINGS

Figure 1:
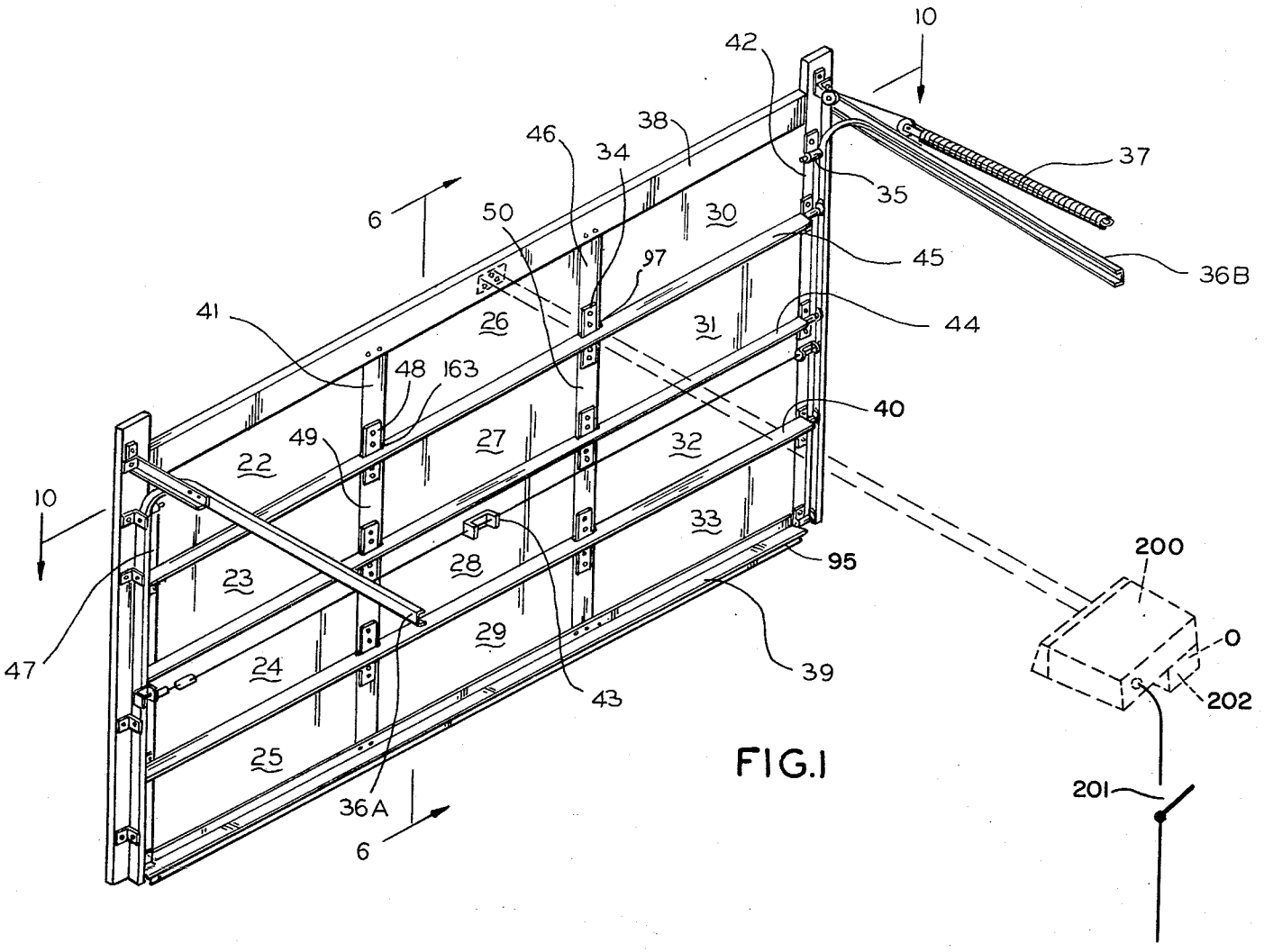
FIG. 1 is a top perspective view of an embodiment of the present articulated overhead door.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

The entire articulated overhead door is illustrated in FIG. 1 and is constructed of blow-molded panel sections 22 through 33. External junction support rail 45 supports and attaches panel section row 22-26-30 to panel section row 23-27-31. External junction support rail 44 supports and attaches panel section row 23-27-31 to panel section row 24-28-32. External junction support rail 40 supports and attaches panel secction row 24-28-32 to panel section row 25-29-33. Bottom edge support rail 39 attaches to the lower horizontal row of panel sections 25-29-33 which forms the bottom edge of the articulated overhead door. Bottom edge support rail 39 additionally restrains and attaches astragal weather strip 95 onto the lower surface of the bottom edge of the articulated overhead door formed by panel sections 25, 29, and 33. Top edge support rail 38 attaches to the top panel section row 22-26-30, forming the upper edge of the articulated overhead door.

Typical standard junction stile 41 attaches and restrains adjoining panel sections 22 and 26, while standard junction stile 46 attaches and restrains adjoining panel sections 26 and 30. Standard junction stile 41 further, is attached to standard junction stile 49 through attachment of both to hinging means 48 which passes through slot 163 in external junction support rail 45 at the same time attaching stiles 41 and 49 to rail 45. Junction stile 41 is also fixedly attached to rail 45 through the use of framework fastening means. Similarly, standard junction stile 46 is attached to standard junction stile 40 by the attachment of the ends of each to hinging means 34 which passes through slot 97 and attaches to external junction support rail 45. End cap edge stiles 42 and 47 cover the right side of panel section 30 and the left side of panel section 22 respectively, these panel sections forming part of the right and left edge respectively of the articulated overhead door. Typical roller bracket 35 to which the axle of the hidden roller wheel is attached, is fastened over end cap edge stile 42.

Conventional guide track means 36A and 36B restrain the overhead articulated door's roller wheels in place so as to direct appropriate panel sections from a vertical position when the door is closed to a horizontal position when the door is open. Additionally, power assist means 37 facilitates the opening of the overhead door by exerting a counter weight spring tension on the garage door when it is in the closed position. Further, control means 43 enables the locking, unlocking, and mechanical opening and closing of the articulated overhead door. Also shown in FIG. 1 is motor means 200 which may be used in combination with the invention herein described for automatic opening and closing of the Articulated Overhead Door. Switch means 201 which is shown schematically in FIG. 1 can be incorporated with motor means 200 or activation of the motor means can be accomplished through radio switch 202.

Figure 2:
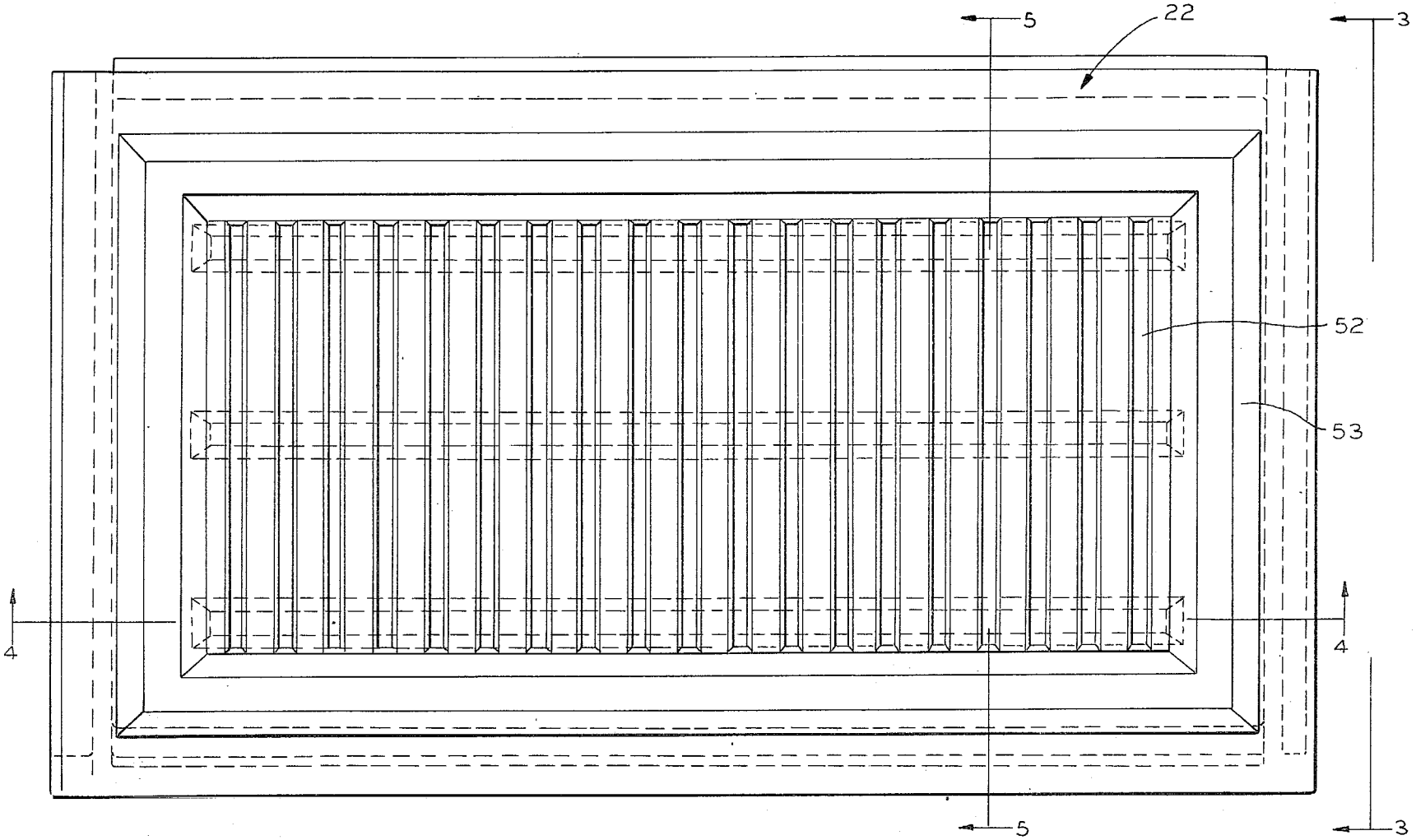
FIG. 2 is a front elevational view of the blow-molded panel section, a series of which form the present invention.

Typical panel section 22 is shown in a front elevational view in FIG. 2. Decorative externally exposed ribbing 52 and framing 53 have been fabricated onto the outside wall of the panel section so as provide a more aesthetically improved appearance of the exposed panel sections.

Figure 3:
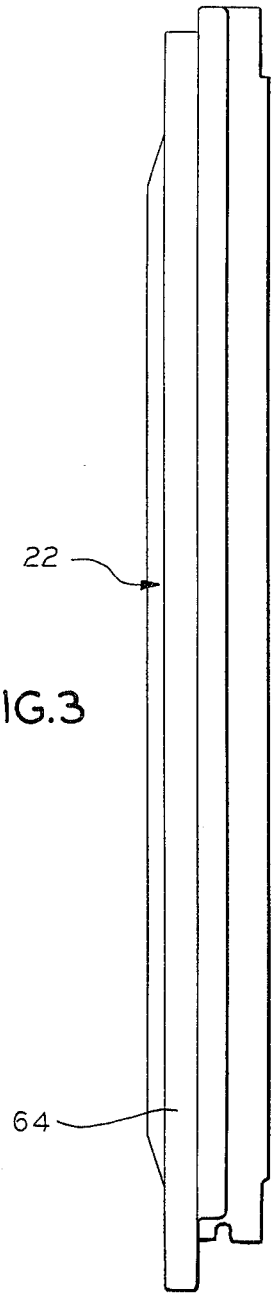
FIG. 3 is a left side elevational view of the blow-molded panel section taken along lines 3—3 and looking in the direction of the arrows.

A side view of typical panel section 22 is shown in FIG. 3 having left side 64. The contour shape of the panel sections shown in FIG. 3 assists in the restraint of the panel section by the surrounding framework. Thus, there is no need for panel fastening devices which would pierce a panel's outer walls and thereby reduce its insulating properties.

Figure 5:
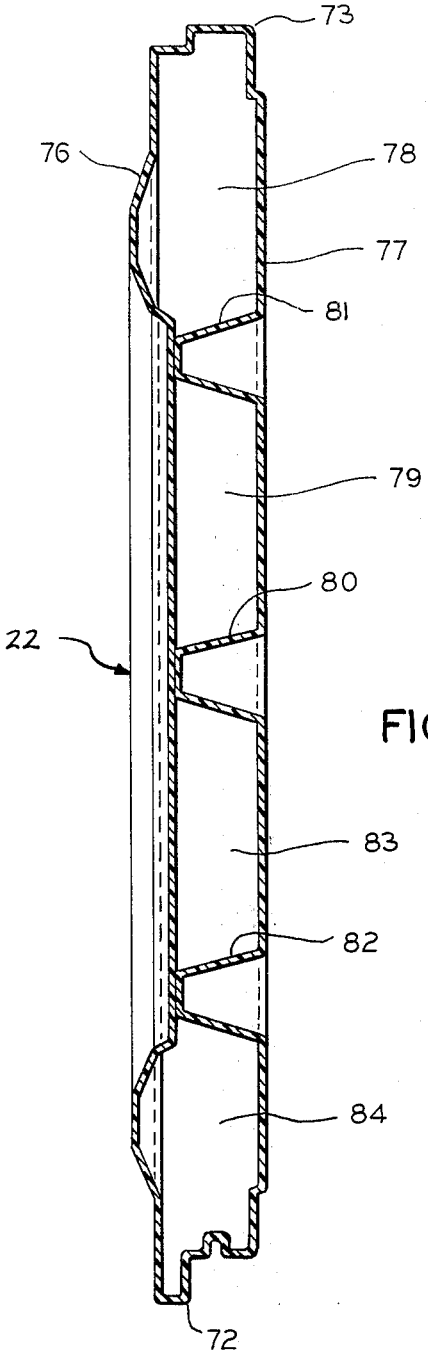
FIG. 5 is a cross-sectional view of the blow-molded panel section taken along lines 5—5 and looking in the direction of the arrows.

A longitudinal section of typical panel section 22 is shown in FIG. 5. The double-walled construction of a panel section is shown with outside wall 76 and inside wall 77. Inside wall 77 is formed so as to provide a series of horizontally displaced ribbed configurations 80, 81, and 82 between the two walls 76 and 77 of the panel section. These ribbed corrugations extend from the left side of the panel section to the right side of the panel section. Dead air spaces 78, 79, 83, and 84 promote the insulation capabilities of each individual panel section and are formed as cavities through the shaping of outside wall 76 with respect to inside wall 77. Specific contour shaping 73 of the top side of the panel section as well as specific contour shaping 72 of the bottom edge of panel section enable overlap and integral fit with the adjacent bottoms and tops, respectively, of adjacent panel sections.

Figure 4:
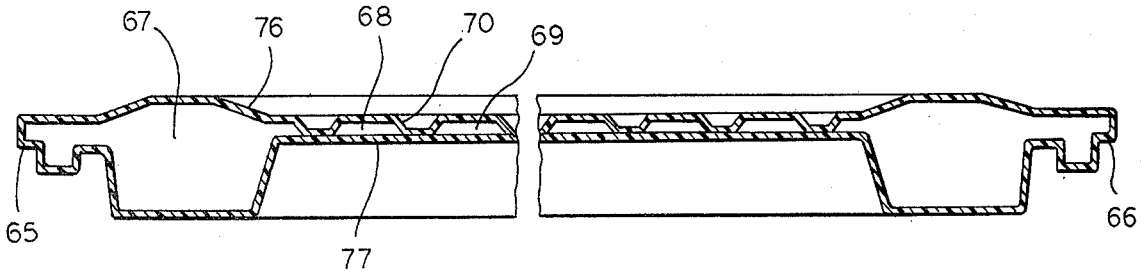
FIG. 4 is a cross-sectional view of the blow-molded panel section taken along lines 4—4 and looking in the direction of the arrows.

A horizontal cross-section of a typical panel section is shown in FIG. 4. The double-walled construction of the panel section is accomplished through blow-molding the panel sections so as to give it a outside wall 76 and an inside wall 77. A series of vertically displaced ribbed configurations such as that shown by rib 70 is fabricated between the two walls 76 and 77 of the panel section and extend from the top side of the panel section to the bottom side of the panel section. Through this construction, cavities are formed within the blow-molded panel section so as to form sealed dead air spaces 67, 68, and 69 whereby insulation is provided in a more improved manner by the panel section. Contour shaping 65 and 66 of the left side and right side, respectively, of the panel section, enable attachment and insteraction of the panel section with the right and left sides, respectively, of adjacent panel sections.

Figure 6:
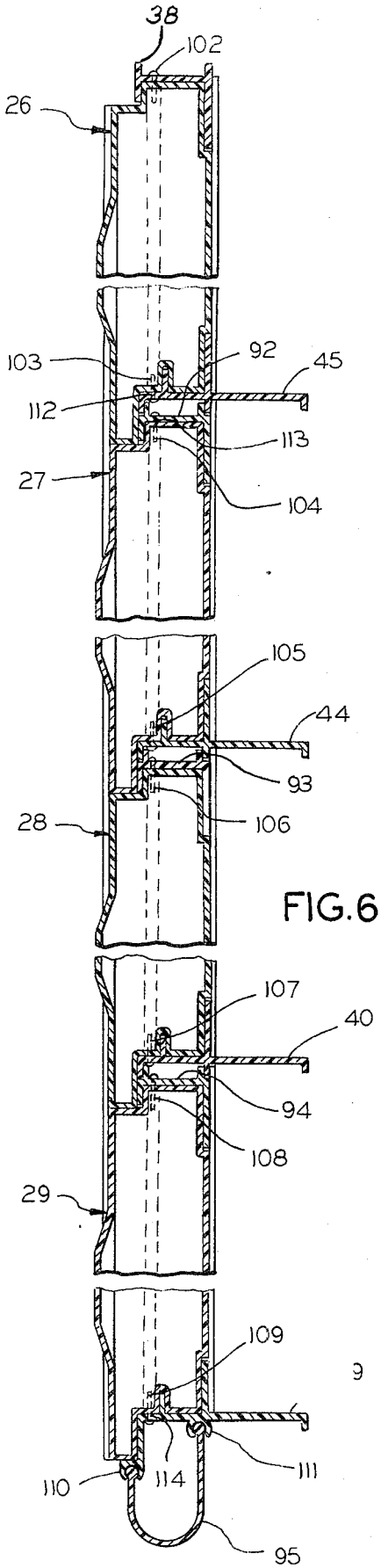
FIG. 6 is an abbreviated cross-sectional view of the articulated overhead door taken along lines 6—6 of FIG. 1, and looking in the direction of the arrows.

A vertical cross-section of the entire articulated overhead door is shown in FIG. 6 of the drawings. The section has been taken through panel sections 26, 27, 28, and 29. Top edge support rail 38 restrains the top side of panel section 26 in place and connects with adjacent vertical stile supports through framework fastening means 102. A panel section is thus framed by two horizontal rail supports and two vertical stile supports which serve to restrain it in place. External junction support rail 45 similarly restrains the bottom side of panel section 26 in the same manner that external junction support rail 44 restrains the bottom side of panel section 27. Both horizontal rail support 45 and 44 attach to adjacent intersecting vertical stile supports through framework fastening means 103 and 105 respectively. Internal junction support rail 92 restrains the top side of panel section 27 and attaches to an intersecting vertical stile support means through framework fastening means 104 in the same manner that internal junction support rail 93 restrains the top side of panel section 28 and attaches to an intersecting vertical stile support means by framework fastening means 106. Additionally, external junction support rail 40 is juxtaposed to the bottom side of panel section 28 through attachment to adjacent vertical stile support means by framework fastening means 107 and internal junction support rail 94 is juxtaposed to the top side of panel section 29 through eventual attachment to an adjacent stile by framework fastening means 108. External junction support rails 45, 44, and 40 are juxtaposed along internal junction support rails 92, 93, and 94 respectively so as to enable pivoting between the external junction support rails and the internal junction support rails, when the panel sections change position relative to one another as the door is moved from a closed to open position or an open to closed position. Bottom edge support rail 39 is maintained in place against the bottom side of lower panel section 29 through comparable attachment of the support rail to its neighboring support stiles. Bottom edge support rail 39 restrains astragal weather strip 95 onto its bottom side through weather strip fastening means 110 and 111.

Figure 7:
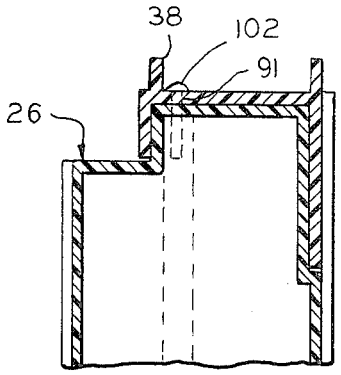
FIG. 7 is a cross-sectional view enlarging, for purposes of clarity, the upper segment of the articulated overhead door shown in FIG. 6.

An enlargement of the top portion of the articulated overhead door shown in FIG. 6 displaying the top edge of panel section 26 as well as top edge support rail 38, second orifice means 91, and framework fastening means 102 is shown in FIG. 7.

Figure 8:
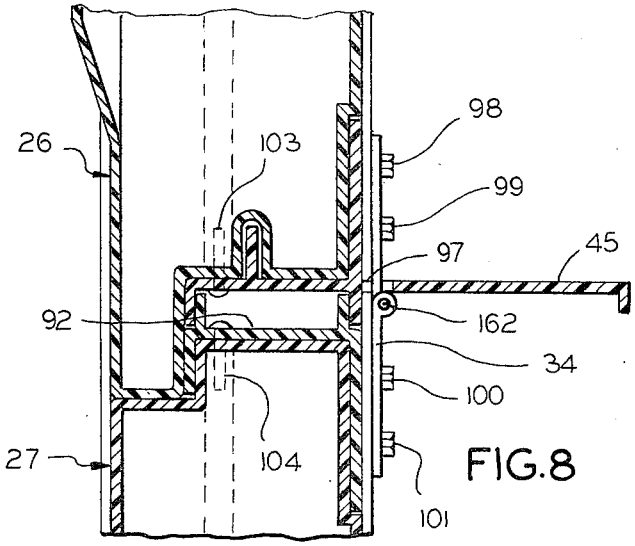
FIG. 8 is a cross-sectional view enlarging, for purposes of clarity, a middle segment of the articulated overhead door shown in FIG. 6.

An enlargement of a lower segment of the articulated overhead door shown in FIG. 6 is set forth in FIG. 8. In this drawing, the junction of panel section 26 and panel section 27 is shown, as well as external junction support rail 45 and internal junction support rail 92, and framework fastening means 103 and 104. FIG. 8 also illustrates the placement of hinging means 34 through slot 97 in external junction support rail 45. The location of hinging swivel 162 is placed below external junction support rail 45 so as to more effectively allow pivoting to occur between external junction support rail 45 and internal junction support rail 92. Hinge fastening means 98, 99, 100, and 101 are inserted through the exposed hinging means 34 into an appropriate vertical stile support means so as to attach rail 45 to joining stiles (not shown).

Figure 9:
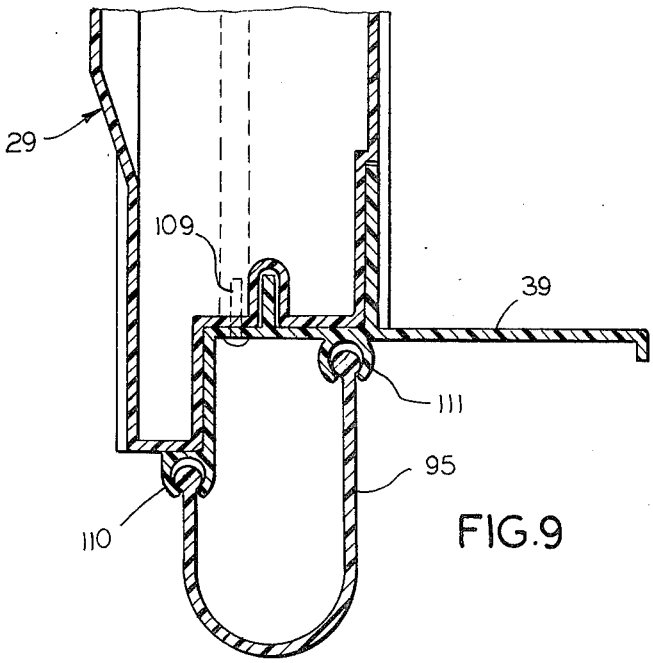
FIG. 9 is a cross-sectional view enlarging, for purposes of clarity, the bottom segment of the articulated overhead door shown in FIG. 6.

An enlargement of the bottom portion of the articulated overhead door shown in FIG. 6 is shown in FIG. 9 illustrating the attachment of bottom edge support rail 39 to the bottom side of panel section 29. Framework fastening means 109 fastens bottom edge support rail 39 to the adjacent stiles framing the left and rights sides of panel section 29 which in turn allows the attachment of astragal weather strip 95 onto the lower surface of bottom edge support rail 39 through weather strip fastening means 110 and 111.

Figure 10:
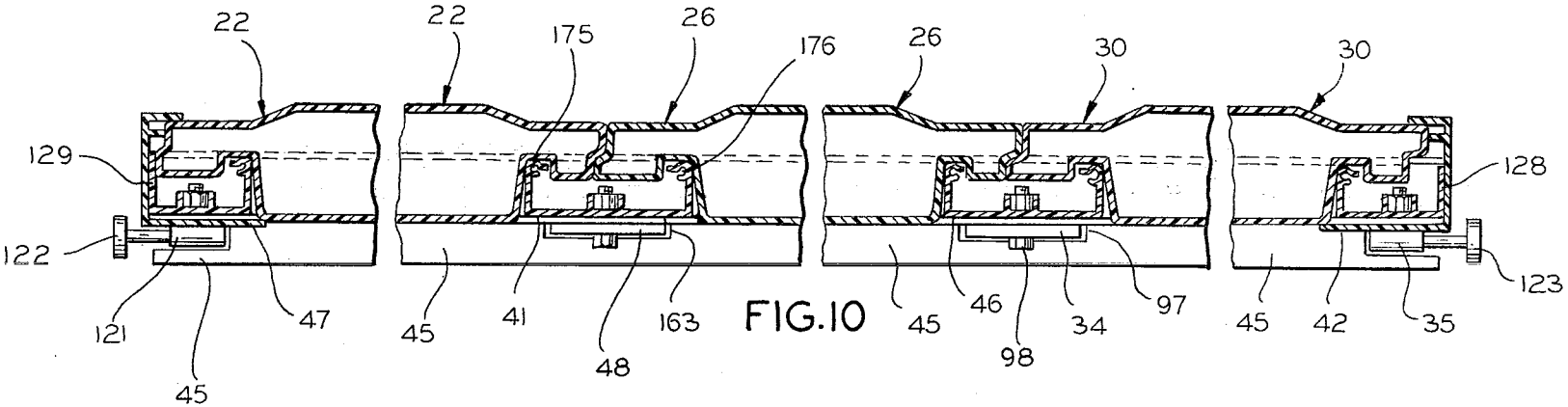
FIG. 10 is a cross-sectional view of the articulated overhead door taken along lines 10—10 of FIG. 1 and looking in the direction of the arrows.

An abbreviated horizontal cross-section of the entire articulated overhead door is shown in FIG. 10 in which panel sections 22, 26, and 30 are shown attached. The left side of panel section 30 is attached to the right side of panel section 26 through the use of standard junction stile 46 in a similar manner as the left side of panel section 26 is attached to the right side of panel section 22 through standard junction stile 41. Hinging means 48 and 34 are shown attached to standard junction stiles 41 and 46 respectively. Hinge fastening means 98 attaches hinging means 34 to standard junction stile 46. Hinging means 48 and 34 are shown inserted through slotted orifices 163 and 97 respectively in external junction support rail 45, which is shown spanning the entire width of the articulated overhead door. Additionally, support rail 45 is further attached to stile 41 through the use of framework fastening means through rail 45 and into screw channels 175 and 176 in standard junction stile 41 and similarly onto all other intersecting vertical stile support means.

Side edge stiles 128 and 129 support and maintain the right and left side edges respectively of the articulated overhead door. Side edge stile 128 extends from the top side of panel section 30 to the bottom side of panel section 30 and side edge stile 129 extends from the top side of panel section 22 to the bottom side of panel section 22, all of which is shown in FIG. 10. End cap edge stiles 42 and 47 which cover side edge stiles 128 and 129 respectively form the permanent edge of the articulated overhead door. Roller brackets 35 and 121 attach onto the surface of end cap edge stiles 42 and 47 respectively. Protruding from roller brackets 35 and 121 are roller wheels 123 and 122 respectively which are inserted into the guiding track for proper maintenance of panel section positioning when the articulated overhead door is either opened or closed.

Figure 11:
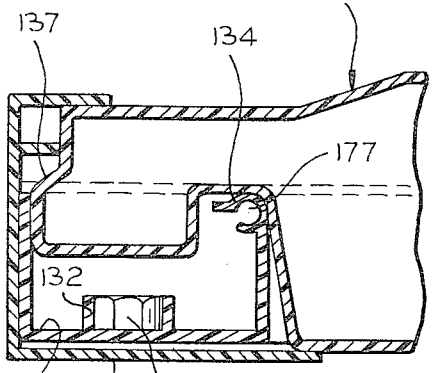
FIG. 11 in a cross-sectional view enlarging, for purposes of clarity, the left side segment of the articulated overhead door shown in FIG. 10.

An enlargement of the left edge segment of the articulated overhead door shown in FIG. 10 is shown in FIG. 11. Restraining channel edge 134 of side edge stile 129 restrains panel section 22 in place by fastening behind and into contour shaping 137 of panel section 22. Screw channel 177 within edge 134 additionally allows attachment of an intersecting horizontal rail support with side edge stile 129 so as to frame panel section 22 in place. Nut positioning means 132 of side edge stile 129 restrains the positioning of nut 133 within side edge stile 129. End cap edge stile 47 is shown securing placement of side edge stile 129 to panel section 22.

Figure 12:
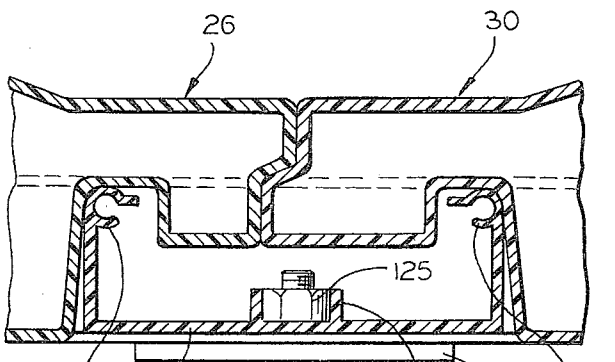
FIG. 12 is a cross-sectional view enlarging, for purposes of clarity, a center segment of the articulated overhead door shown in FIG. 10.

An enlargement of an interior segment of the articulated overhead door shown in FIG. 10 is shown by FIG. 12. Restraining channel edges 127 and 126 restrain into place the contour shaped side edges of panel sections 30 and 26 respectively. Nut positioning means 124 of standard junction stile 46, maintains nut 125 in position to allow the insertion of hinge fastening means 98 which secures hinging means 34.

Figure 13:
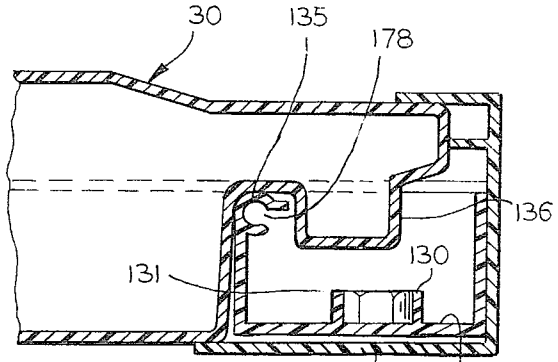
FIG. 13 is a cross-sectional view enlarging, for purposes of clarity, the right side segment of the articulated overhead door shown in FIG. 10.

An enlargement of the right edge segment of the articulated overhead door section shown in FIG. 10 is shown in FIG. 13 in which panel section 30 has its right contoured side 136 restrained by side edge stile 128, having nut positioning means 130 which in turn restrains nut 131. Restraining channel edge 135 on side edge stile 128 makes possible the restraint of contoured side 136 of panel section 30. Screw channel 178 within edge 135 additionally allows attachment of an intersecting horizontal rail support with side edge stile 128 so as to frame panel section 30 in place. End cap edge stile 42 additionally covers side edge stile 128 so as to secure the positioning of said side edge stile 128 and allow the placement of necessary hinging means and roller bracket means after its attachment.

Figure 14:
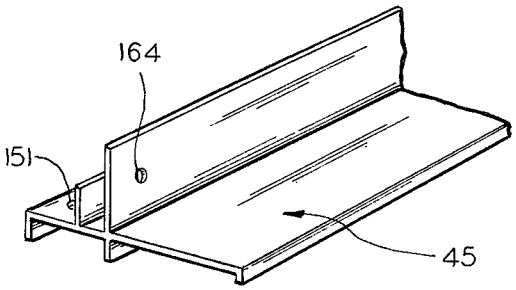
FIG. 14 is a side perspective view of the external junction support rail incorporated into the construction of the articulated overhead door.
Figure 15:
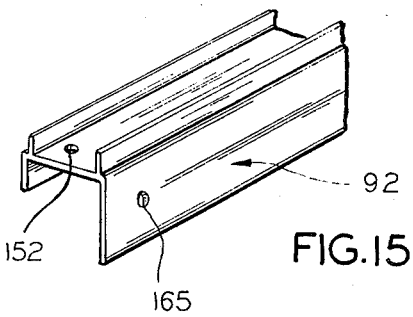
FIG. 15 is a side perspective view of the internal junction support rail which can be used as a top edge support rail in the construction of the articulated overhead door.
Figure 16:
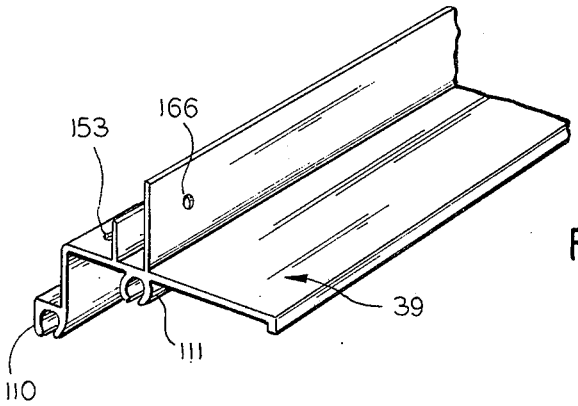
FIG. 16 is a side perspective view of the bottom edge support rail used in the construction of the articulated overhead door.
Figure 17:
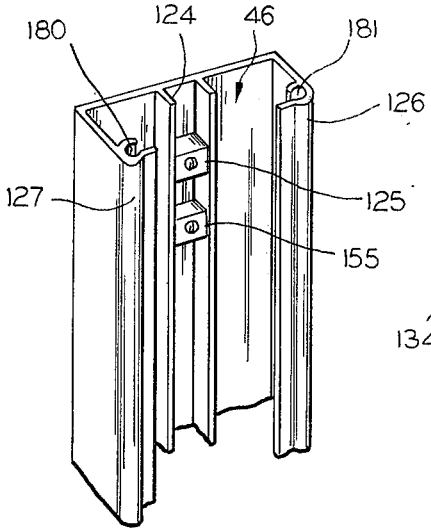
FIG. 17 is a top perspective view of the standard junction stile used in the construction of the articulated overhead door.
Figure 18:
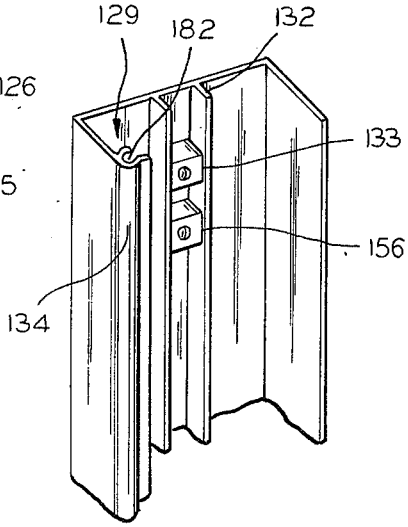
FIG. 18 is a top perspective view of the side edge stile used in the construction of the articulated overhead door.
Figure 19:
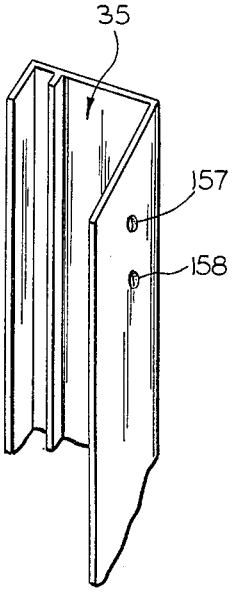
FIG. 19 is a top perspective view of the end cap edge stile used in the construction of the articulated overhead door.
Figure 20:
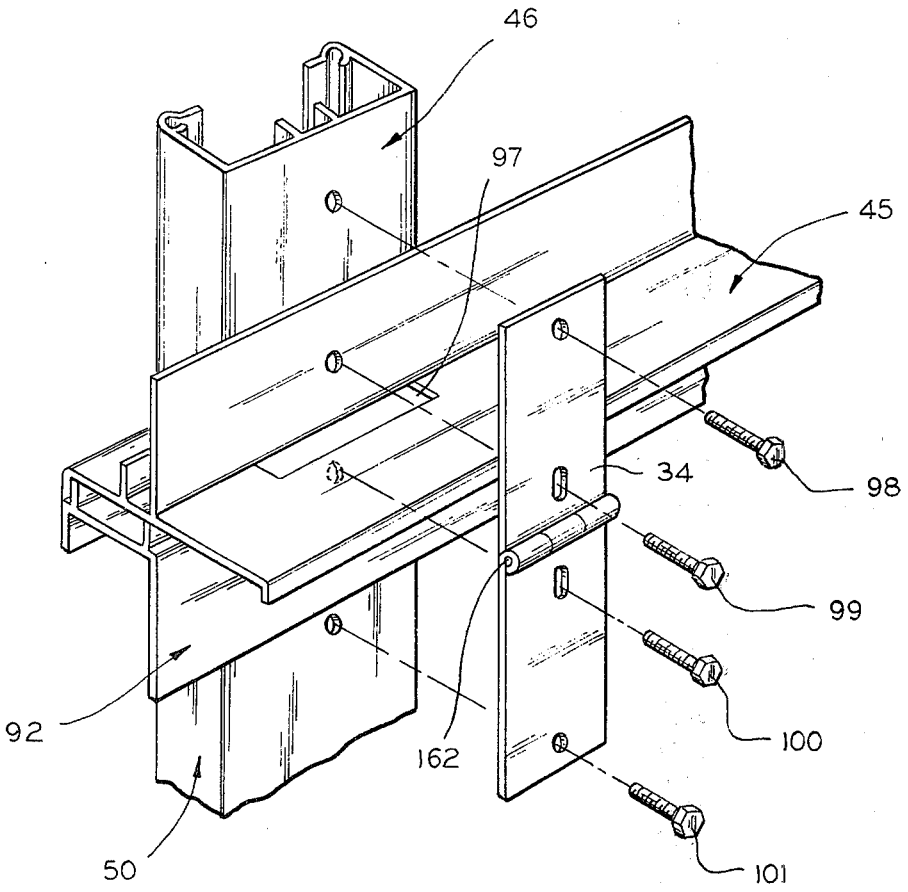
FIG. 20 is an exploded side perspective view of a typical horizontal rail support-vertical stile support intersection, showing hinging means attachment through both and hinging means passage through the slotted horizontal support rail.

FIG. 14 through FIG. 19 show the various shapes of the extruded aluminum horizontal support rails and vertical support stile means. FIG. 14 shows external junction support rail 45 having first orifice means 151 enabling attachment to an adjacent vertical stile support means and first hinge attachment orifice 164. Internal junction support rail 92 is shown in FIG. 15 having second orifice means 152 which enables attachment of internal junction support rail 92 to an adjoining vertical stile support means, and second hinge attachment orifice 165. When internal junction support rail 92 is used as a top edge support rail, orifice 165 enables attachment of the top edge rail directly to intersecting vertical stile support means. Bottom edge support rail 39 is shown in FIG. 16 having third orifice means 153 so as to enable attachment to an adjacent intersecting vertical stile support means. Weather strip fastening means 110 and 111 and terminating orifice means 166 are also shown in FIG. 16. No separate top edge support rail is shown since the particular embodiment shown utilizes the internal junction support rail 92 of FIG. 15 for that purpose. Standard junction stile 46 is shown in FIG. 17. Nut positioning means 124 allows the positioning and restraint of nuts 125 and 155 within the channel shape of the standard junction stile 46. Additionally, restraining channel edges 127 and 126 enable restraint of the contoured shaping of two adjoining panel sections. Screw channels 180 and 181 enable attachment of stile 46 to adjacent intersecting horizontal rail support means. Side edge stile 129 is shown in FIG. 18. Nut positioning means 132 restrains and positions nuts 133 and 156. Restraining channel edge 134 facilitates the restraint of the edge of a panel section by side edge stile 129 and screw channel 182 enables attachment of stile 129 to adjacent intersecting rail support means. End cap edge stile 35 is shown in FIG. 19 having fifth orifice means 157 and 158 through which hinge fastening means pass so as to enable attachment of roller bracket means, hinging means, and end cap edge stile 35 to an internally positioned side edge stile.

A typical intersection of horizontal rail support means and vertical stile support means is shown in FIG. 21. Standard junction stile 46 attaches to successive standard junction stile 50 through the attachment of stile 46 to rail 45, of stile 50 to rail 92 and the attachment of stile 46 and rail 45 to the top of hinging means 34, while stile 50 and rail 92 attach to the bottom portion of hinging means 34. Standard junction stile 46 is positioned within the back portion of external junction support rail 45 while standard junction stile 50 is positioned and maintained within the back portion of internal junction support rail 92. Hinging means 34 is inserted through slot 97 on the external junction support rail 45. Hinge fastening means 98, 99, 100, and 101 attach hinging means 34 to junction support rail 45 and standard junction stiles 46 and to internal junction support rail 92 and standard junction stile 50. In this same manner, all horizontal rail support means are attached to intersecting vertical stile support means so as to provide secure and restrained positioning of all panel sections maintained by the horizontal rail support means and vertical stile support means. Hinging swivel 162 is placed slightly below the position of slot 97 so as to allow pivoting between the external junction support rail and the internal junction support rail.

The foregoing description and drawings merely explain and illustrate the invention and the invention is not limited thereto, except in so far as the appended claims are so limited, as those skilled in the art who have the disclosure before them will be able to make modifications and variations therein without departing from the scope of the invention.

I claim:

1. An articulated overhead door comprising:

a series of panel sections of blow-molded material having substantially hollow cavities within a substantially double-walled construction, said panel sections having means to enable increased strength within said substantially hollow cavities, said panel sections having means within said double-walled construction to enable insulation, said panel sections having means for attachment and interaction with said other panels of said series, a plurality of vertical stile support means spanning the height of said door, a plurality of horizontal rail support means spanning the length of said door, guiding track means which direct the movement of the overhead door whereby the door moves to a substantially horizontal position over the interior of a building when opened and is returned to secure vertical position when closed, roller means on the edges of said door which ride in said guiding track means, power assist means to facilitate opening of said door from a closed position to an open position, and control means which enable the locking, unlocking, and mechanical opening and closing of said door.

2. The invention of claim 1 in which said panel sections have a rectangularly shaped structure of blow-molded polyethylene plastic.

3. The invention according to claim 2 in which said means to enable increased strength comprises:

a. a series of vertically displaced ribbed corrugations fabricated between the two walls of said panel section and extending from the top side of said panel section to the bottom side of said panel section, and b. a series of horizontally displaced ribbed corrugations fabricated between the two walls of said panel section and extending from the left side of said panel section to the right side of said panel section.

4. The invention according to claim 3 in which said means for enabling insulation within said panel section comprises a sealed hollow cavity dead air space whereby insulation is provided by said double wall construction and air retained between said double walls.

5. An articulated overhead door comprising:

a series of panel sections of blow-molded material having substantially hollow cavities within a substantially double-walled construction, said panel sections having means to enable increased strength within said substantially hollow cavities;

said panel sections having means within said double-walled construction to enable insulation, said means for enabling insulation comprising a sealed hollow cavity dead air space whereby insulation is provided by the double wall construction and air retained between said double wall;

said panel sections having means for attachment and interaction with said other panels of said series, said means for attachment and interaction of said panels comprising vertical attachment and interaction means whereby the top sides and bottom sides of said panel sections attach and interact with the bottom sides and top sides respectively of adjacent panel sections, said vertical attachment and interaction means comprising contour shaping of the top sides and bottom sides of the panel section;

a plurality of vertical stile support means spanning the height of said door;

a plurality of horizontal rail support means spanning the length of said door;

said vertical attachment and interaction means also comprising said horizontal rail support means having a grooved shape into which said top sides and bottom sides of said panel sections are inserted and restrained;

said vertical attachment and interaction means further comprising hinging means passing through said horizontal rail supports and attaching said horizontal rail supports to said vertical stile supports through the use of hinge fastening means;

guiding track means which direct the movement of the overhead door whereby the door moves to a substantially horizontal position over the interior of a building when opened and is returned to a secure vertical position when closed;

roller means on the edges of said door which ride in such guiding track means;

power assist means to facilitate opening of said door from a closed position to an open position; and control means which enable the locking, unlocking, and mechanical opening and closing of said door.

6. The invention according to claim 5 in which said means for attachment and interaction of said panels with said other panels further comprises:

horizontal attachment and interaction means whereby the left sides and right sides of said panel sections attach and interact with the right sides and left sides respectively of adjacent panel sections, said horizontal attachment and interaction means comprising contour shaping of the left sides and right sides of said panel sections, said horizontal attachment and interaction means further comprising said vertical stile support means having a flanged channel shape with restraining upper channel edges, said restraining upper channel edges being inserted into said contour shaping of said right side and said left side of said adjoining panel sections so as to restrain said adjoining sections in place, and said vertical stile support means being maintained in place by said hinging means which pass through and attach said horizontal rail supports to said vertical stile support means by hinge fastening means.

7. The invention according to claim 6 in which said horizontal rail support means comprises:

external junction support rails which extend from between an upper and a lower row of joining panel sections protruding beyond the inside walls of said panels, said external junction support rails having first orifice means whereby said external support rail is attached to said vertical stile support means by framework fastening means, said external junction support rails having slotted orifices where said external standard support rail intersect said vertical stile support means whereby said hinging means can pass through and attach said external junction rail supports to said vertical stile support means, and said external junction rails having first hinge attachment orifice means through which said hinge fastening means attach said external junction support rails to said vertical stile support means and said hinging means.

8. The invention acccording to claim 7 in which said horizontal rail support means further comprises:

internal junction support rails which extend from between said upper and said lower row of joining panel sections towards the inside walls of said panel sections and which curve around the lower one of said two rows, said internal junction support rails having second orifice means whereby said internal junction support rail is attached to said vertical stile support means by framework fastening means, said internal junction support rails juxtaposed to said external junction support rail so as to enable swiveling rotation between said upper and lower rows of joining panel sections, and said internal junction support rails having second hinge attachment orifice means through which said hinge fastening means attach said internal junction support rail to said vertical stile support means and said hinging means.

9. The invention according to claim 8 in which said horizontal rail support means further comprises:

a bottom edge support rail juxtaposed against a lower horizontal row of the panel sections forming the bottom edge of said door, said bottom edge support rail having terminating orifice means so as to enable attachment by bottom edge rail fastening means to said vertical stile support means, said bottom edge support rail restraining an astragal weather strip on the lower surface of said bottom edge support rail through weather strip fastening means, and said bottom edge support rail having third orifice means whereby said bottom edge support rail is attached to said vertical stile support means by said framework fastening means.

10. The invention according to claim 9 in which said horizontal rail support means further comprises:

a top edge support rail juxtaposed against a top row of said panel sections forming the upper edge of said door, and said top edge support rail comprising said internal junction support rail.

11. The invention according to claim 9 in which said vertical stile support means comprises:

standard junction stiles having nut positioning means within said channel shaping to enable insertion into said channel of said hinge fastening means or said bottom or top edge rail fastening means, for attachment of said hinging means or said bottom or top edge support rails respectively, said junction stiles having screw channel means for attachment to said horizontal rail support means through framework fastening means.

12. The invention according to claim 11 in which said vertical stile support means further comprises:

side edge stiles supporting and maintaining said side edges of said door from the top of each panel section to the bottom of said panel section, said restraining upper channel edge of said side edge stile being inserted into said contour shaping of said panel section forming the side edge of said door so as to enable said side edge stile to cover said side edge of said door, said side edge stiles attaching by said hinge fastening means to said hinging means at the top side and bottom side of each said panel section forming the side edge of said door and intersecting and attaching to said horizontal rail support means at said hinging means, said side edge stiles having screw channel means for attachment to said horizontal rail support means through framework fastening means, and said side edge stile support maintained in place by said hinging means which pass through said slotted orifice of said horizontal rail supports and attach said side edge stile to said horizontal rail support means.

13. The invention according to claim 12 in which said vertical stile support means further comprises:

end cap edge stiles which cover said side edge stiles from the top side of each said panel section forming said edge of said door to the bottom side of each said panel section, and said end cap edge stile having fifth orifice means enabling the insertion of said hinge fastening means or said top or bottom edge rail fastening means into said side edge stile through said end cap edge stile and through said hinging means and said roller means, whereby said end cap edge stile, said hinging means or said top or bottom edge support rails respectively, and said roller means are attached to said side edge stile.

14. The invention according to claim 13 in which said horizontal rail support means and said vertical stile support means are fabricated of extruded aluminum.

15. The invention according to claim 14 in which said roller means comprises:

an axled roller wheel securely restrained in said guiding track means to enable rotational movement of said roller wheel in said guiding track means, and roller bracket means to which the axle of said roller wheel is attached so as to allow roatation of said axle, said roller bracket means having bracket orifices for secure attachment by said hinge fastening means or said top or bottom edge rail fastening means into said side edge stiles through said end cap edge stiles, and said hinging means or said top or bottom edge support rails respectively, whereby said roller wheel is attached to said side edge of said door.

16. The invention according to claim 15 in which power assist means to facilitate opening of said garage door comprises a tension spring assembly.

17. The invention according to claim 16 in which said door control means comprises a door locking hand grip assembly on the exterior wall of said door.

18. The invention according to claim 16 in which said door control means comprises a motor assembly attached to said door, which can be activated to open and close said door by switching means.

* * * * *

UNITED STATES PATENT OFFICE

CERTIFICATE OF CORRECTION

Patent No. 3,980,123 Dated September 14, 1976

Inventor(s) LOUIS N. VAGO

It is certified that error appears in the above-identified patent and that said Letters Patent are hereby corrected as shown below:

| | |
|---|---|
| Col. 2, line 67: | After the word "hinges","traveling" should read --traversing--. |
| Col. 3, line 24: | After "U.S. Pat. No.", "3,256,118" should read -- 3,265,118--. |
| Col. 6, line 19: | After FIG. 11, "in" should read --is--. |
| Col. 7, line 23: | After "junction stile", "40" should read --50--. |

Signed and Sealed this

Eleventh Day of January 1977

[SEAL]

*Attest:*

RUTH C. MASON
*Attesting Officer*

C. MARSHALL DANN
*Commissioner of Patents and Trademarks*